United States Patent [19]

Rozmus

[11] 4,041,74

[45] Aug. 16, 19

[54] APPARATUS AND METHOD FOR COLD WORKING METAL POWDER

[75] Inventor: Walter J. Rozmus, Birmingham, Mich.

[73] Assignee: Kelsey-Hayes Company, Romulus, Mich.

[21] Appl. No.: 649,540

[22] Filed: Jan. 15, 1976

[51] Int. Cl.[2] ..... B21B 9/00

[52] U.S. Cl. ..... 72/38; 72/45; 72/201; 72/366; 75/214; 29/420

[58] Field of Search ..... 29/420, DIG. 31; 75/214; 72/201, 236, 38, 43, 45, 365, 366; 241/48, 79.1

[56] References Cited

U.S. PATENT DOCUMENTS

| | | | |
|---|---|---|---|
| 2,222,251 | 11/1940 | Calkins et al. | 75/214 |
| 2,689,398 | 9/1954 | Gaut et al. | 29/DIG. 31 |
| 3,041,716 | 7/1962 | Herenguel | 75/214 |
| 3,434,669 | 3/1969 | Giambattista | 241/48 |
| 3,604,237 | 9/1971 | Kawanami et al. | 72/201 |

FOREIGN PATENT DOCUMENTS

| | | | |
|---|---|---|---|
| 1,266,508 | 3/1972 | United Kingdom | 72/236 |
| 964,002 | 7/1964 | United Kingdom | 29/ |

*Primary Examiner*—Lowell A. Larson
*Attorney, Agent, or Firm*—McGlynn and Milton

[57] ABSTRACT

An apparatus and method for cold working metal po der to produce a metal powder highly suited for cons idation wherein the apparatus comprises a cold rolli mill including a pair of driven rolls mounted withi sealed work chamber for receiving and deforming closely metered amount of powder. The work chaml is continuously purged with an inert atmosphere protect the powder from gaseous contaminants a circulating and filter means is provided for removi solid contaminants. To facilitate cold rolling the po der is lubricated prior to passage through the rolls a brushes are provided for cleaning any adhering pow from the surface of the rolls. The resulting cold work powder particles have a coin, or plate-like, shape a demonstrate desirable properties for hot consolidati such as, a low incidence of hollow particles and nonm tallic inclusions, the capability of achieving a conditi of superplasticity, and an increased tap density of loose powder.

29 Claims, 8 Drawing Figures

APPARATUS AND METHOD FOR COLD WORKING METAL POWDER

This invention relates to a device for cold working metal powder for the primary purpose of introducing strain energy into the individual powder particles. Additionally, cold rolling with the instant invention facilitates elimination of void-producing hollow particles and nonmetallic inclusions as well as increasing the tap density of the powder.

In the consolidation of metal powder, particularly nickel and cobalt base superalloys, by hot isostatic pressing, it has been found advantageous to cold work the metal powder prior to consolidation. The strain energy imparted to the individual powder particles lowers the recrystallization temperature of the alloy and, upon heating during hot isostatic pressing to a temperature above the lowered recrystallization temperature, results in a condition known as superplasticity. The condition of superplasticity is characterized by a drastic reduction in the flow stress of the material and, in terms of hot isostatic pressing, permits consolidation of the powder at lower temperatures and pressures than would normally be required. Maintaining this condition of superplasticity in the consolidated billet or preform also permits a reduction in the temperature and pressure of subsequent hot forging operations.

Up until recent times, it has been believed that excess cold work in the metal powder hindered, rather than benefited, consolidation due to the increased hardness of the particles. In fact, when the method of producing the metal powder inherently resulted in highly cold-worked particles, the metal powder was annealed prior to further processing to eliminate the strain energy. The earliest recognition that metal powder in the cold worked state is beneficial is contained in U.S. Pat. No. 3,728,088 granted Apr. 17, 1973. This patent discloses a ball mill type apparatus for producing a superalloy powder by mechanically alloying powders of the constituent elements. Since the operation is carried out at temperatures far below annealing temperatures, the resulting superalloy powder is highly stressed or cold worked. The apparatus disclosed is the only prior art device known which results, though incidentally, in producing cold worked metal powder which is then used in subsequent processing in the cold worked state.

The instant invention provides an apparatus for introducing strain energy into metal powder (i.e., cold working) by cold rolling. The invention is particularly suited for cold working metal powder which has been produced by the atomization process. Individual particles of atomized powder are generally spherical in shape. Cold rolling in the manner of the instant invention is a deformation process which changes the shape of the particles from spherical to coin, or plate-like, shaped particles. This is accomplished by achieving at least a 40% reduction of the dimension of the spherical particle along one of its major axes.

In addition to imparting sufficient strain energy to produce superplastic powder, a number of other advantages are obtained by employing the instant invention. Quite frequently the powder particles produced by the atomization process are hollow. Such hollow particles may produce voids in the consolidated article and are, therefore, undesirable. The powder rolling mill of the instant invention effectively eliminates hollow particles since the particles are flattened into a coin, or ellipsoid-like, shape. Another potential source of flaws in the consolidated article are nonmetallic inclusions. Nonmetallic inclusions consist of small pieces of refractory material which break off the tundish, nozzle and other parts of the atomization equipment and are inadvertently introduced into the powder during the atomization process. Since the pieces of refractory material are quite brittle, the powder rolling mill crushes or breaks them up into very fine particles. The powder rolling mill of the instant invention is provided with a filter system which is adapted to remove such particles and other fines.

Another important advantage achieved by cold working the metal powder in the manner of the instant invention is that the tap density of the rolled powder is increased over that of as-atomized powder. Tap density is the apparent density of the powder obtained when it is loaded into a container. An increase in tap density means an increase in the amount of powder contained in a specified volume. In other words, increasing tap density increases the mass/volume ratio. This is advantageous since a greater mass/volume ratio facilitates sintering of the metal powder and the ultimate density of the densified article.

In accordance with the foregoing, the instant invention provides a method and apparatus for cold rolling powder metal which includes a pair of rolls mounted for rotation within an enclosed chamber and means for rotatably driving the rolls. The powder metal is introduced to the rolls through metering means. The metering means is adapted to control the rate of powder flow to the rolls to insure substantially consistent cold working of all the particles. Since nickel and cobalt base superalloys are highly reactive, means is provided for introducing an inert gas into the enclosed chamber to protect the powder from contaminating atmospheric gases. Circulating and filter means is also provided for removing the inert gas from the chamber, filtering the inert gas to remove solid contaminants, such as, pieces of refractory material, and returning the filtered inert gas to the chamber. In order to prevent the powder particles from adhering to the surface of the rolls, lubricating means is provided for lubricating the metal powder prior to its passage through the rolls.

Other advantages of the present invention will be readily appreciated as the same becomes better understood by reference to the following detailed description when considered in connection with the accompanying drawings wherein:

FIG. 1 is a schematic drawing showing a front-elevational view of a cold rolling apparatus for metal powder constructed in accordance with the instant invention;

FIG. 1*a* is an enlarged, cut-away, detail view showing the metering valve of the instant invention;

Figure 3:
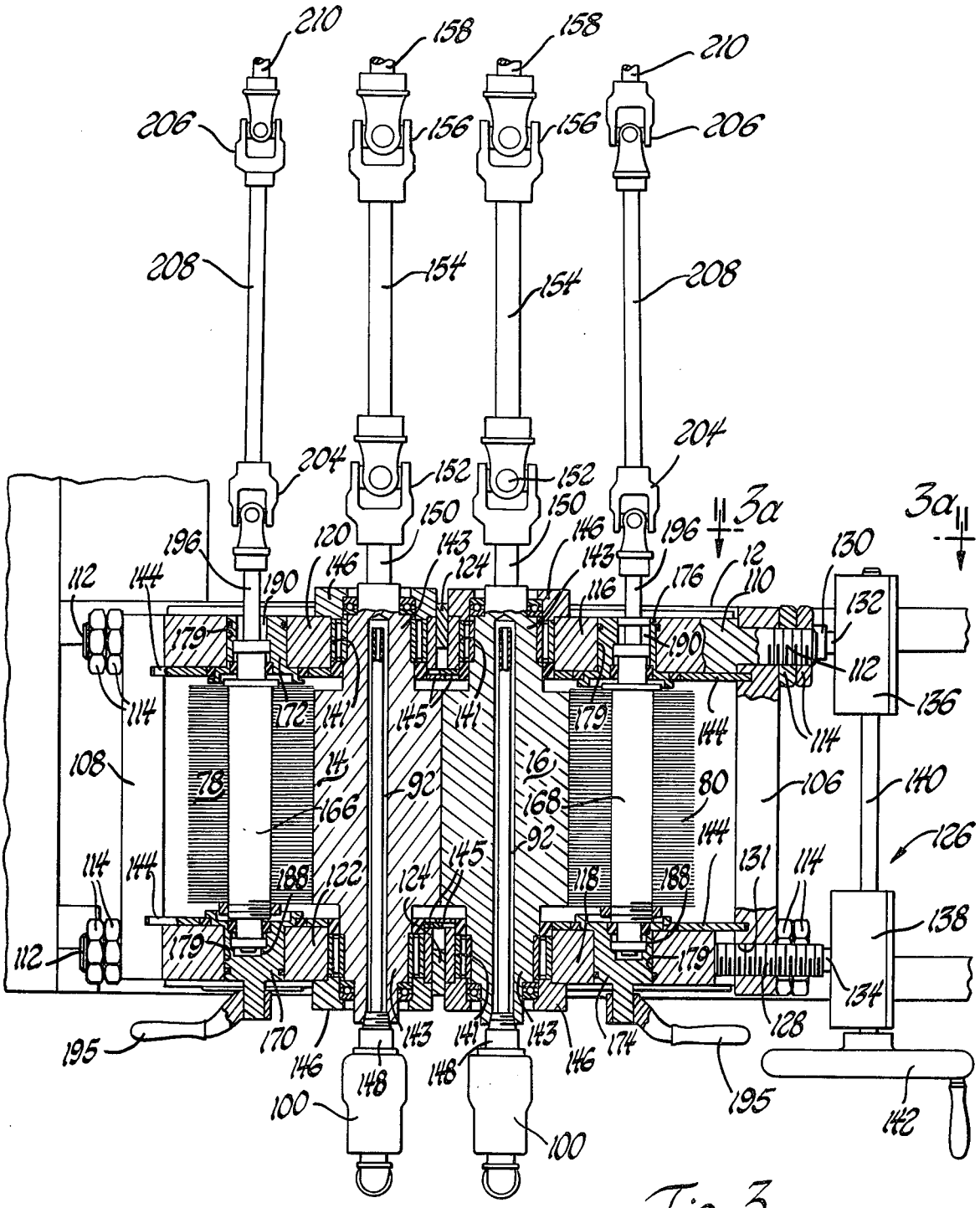
FIG. 3 is a machine drawing of the internal parts of the cold rolling apparatus when viewed generally along line 3—3 of FIG. 1.
Figure 3A:
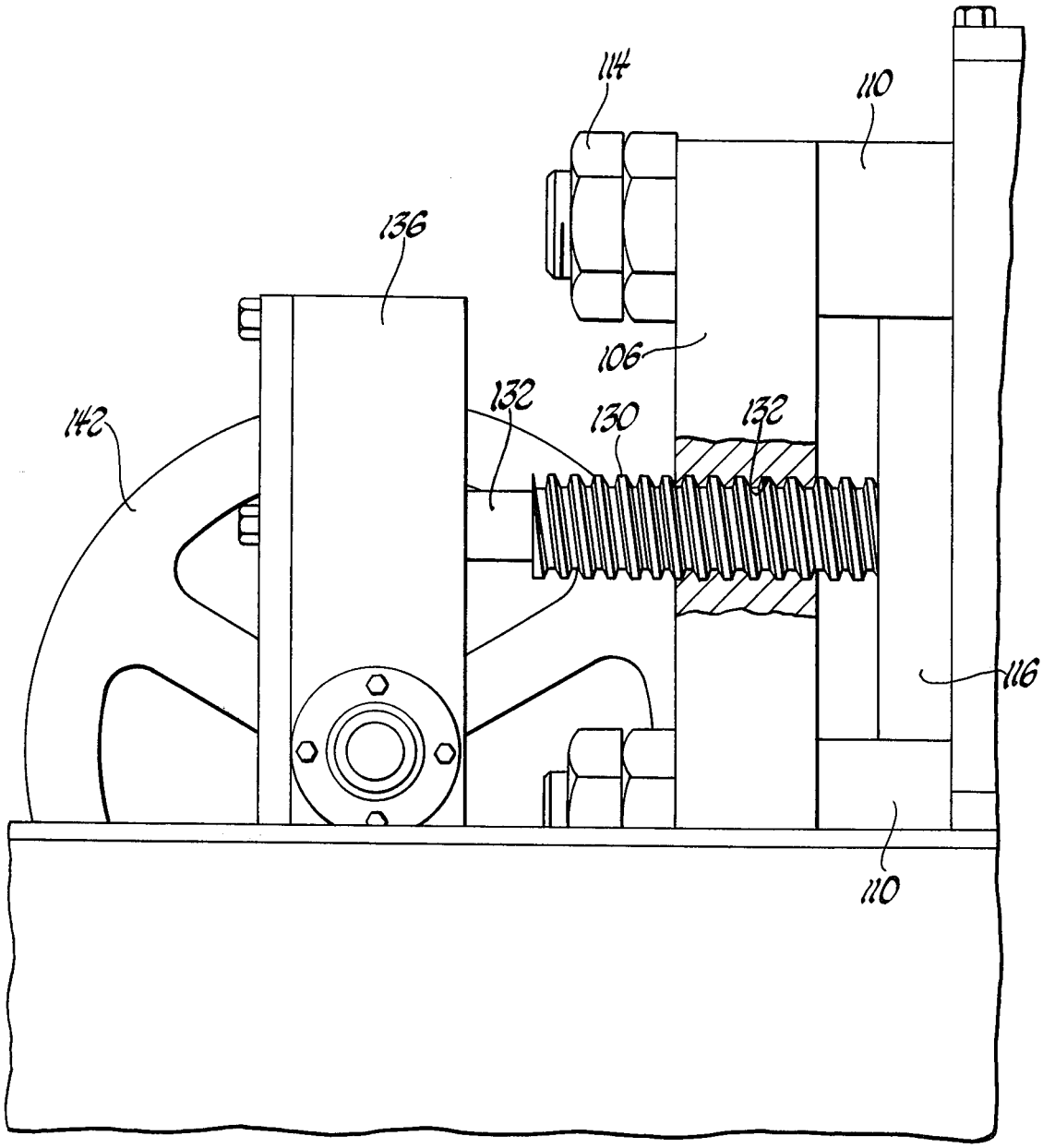
Figure 4:
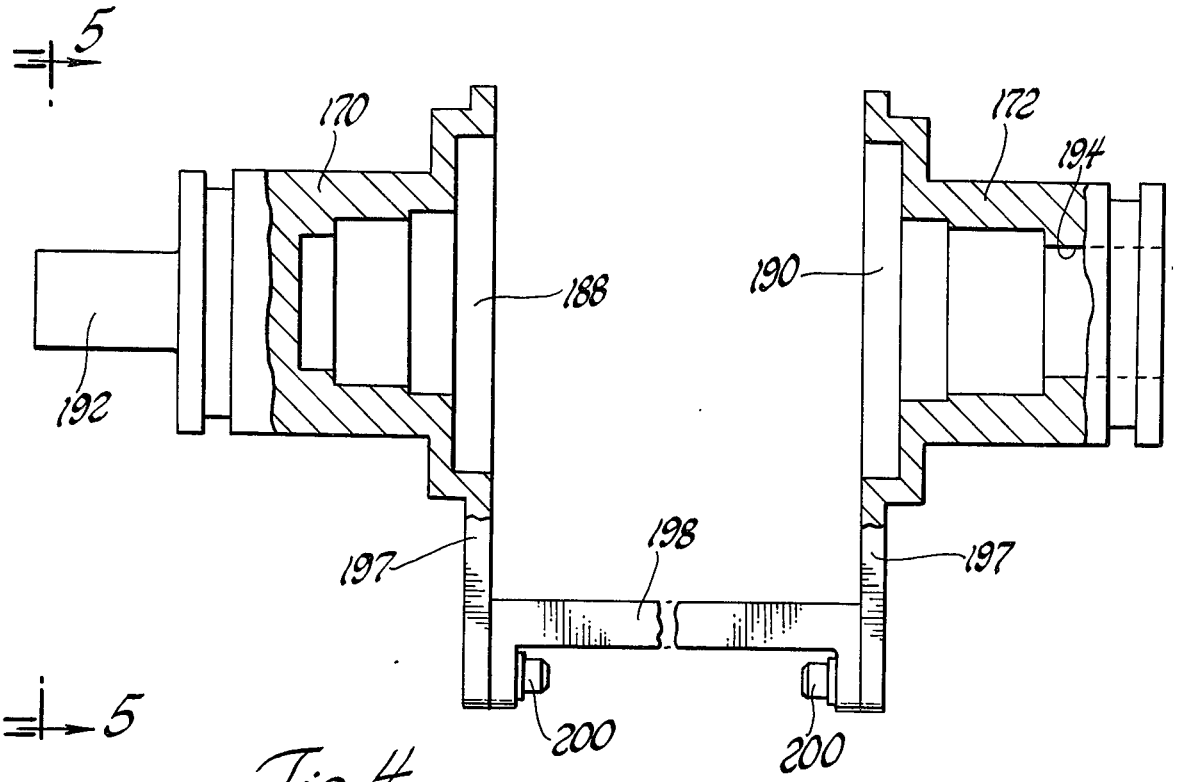
Figure 5:
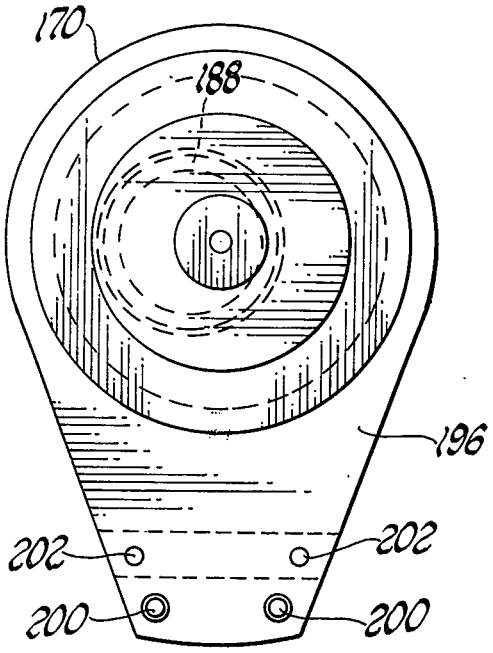

FIG. 3*a* is rear-elevational view of a section of the apparatus taken generally along line 3*a*—*3a* of FIG. 3;

FIG. 4 is a side-elevational view, partly in cross section, of a detail of the cold rolling apparatus;

FIG. 5 is a view taken generally along line 5—5 of FIG. 4; and

Figure 6:
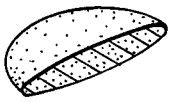

FIG. 6 is a cross-sectional, perspective view of a cold rolled powder metal particle produced in accordance with the instant invention.

Figure 1:
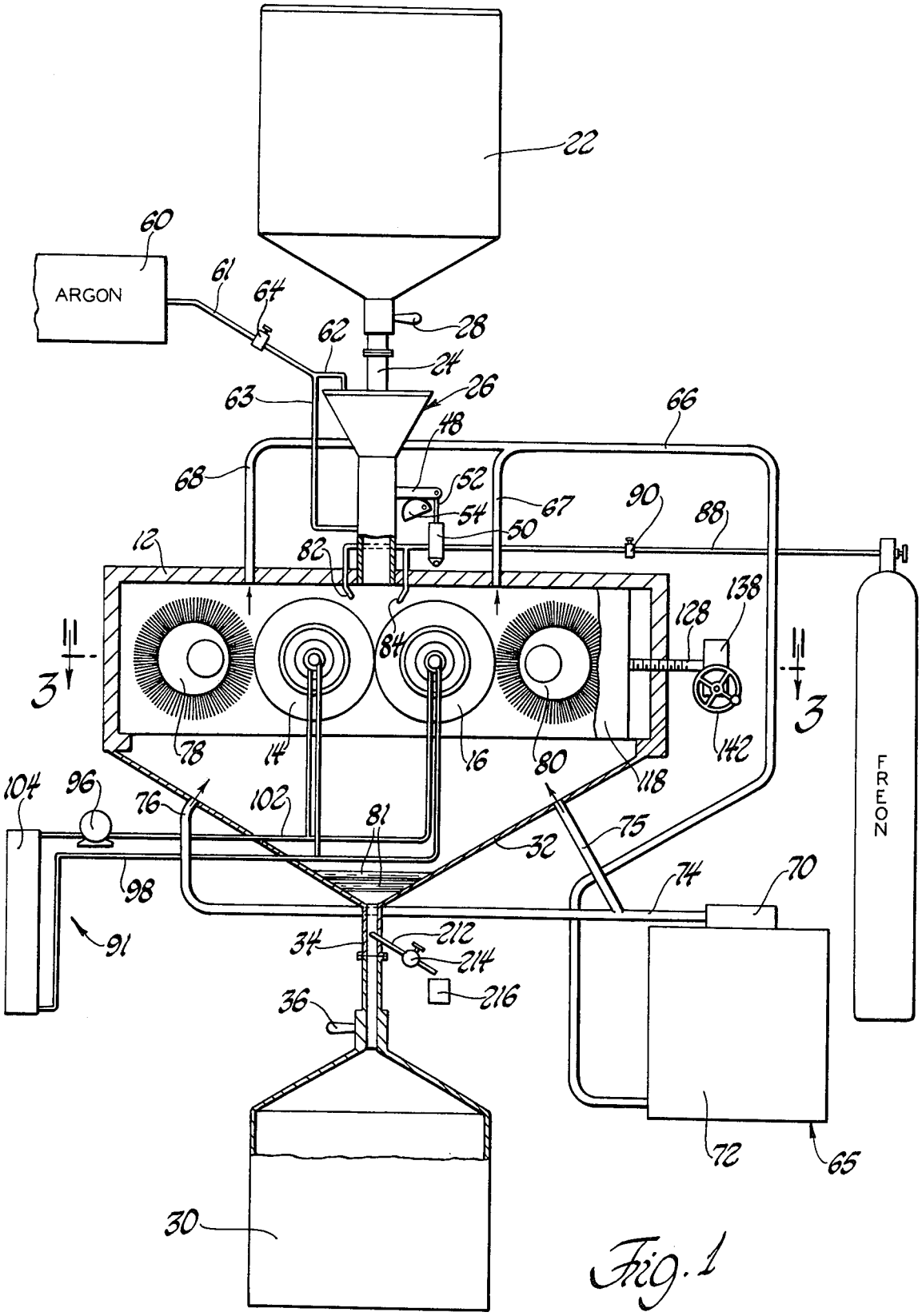
Figure 1A:
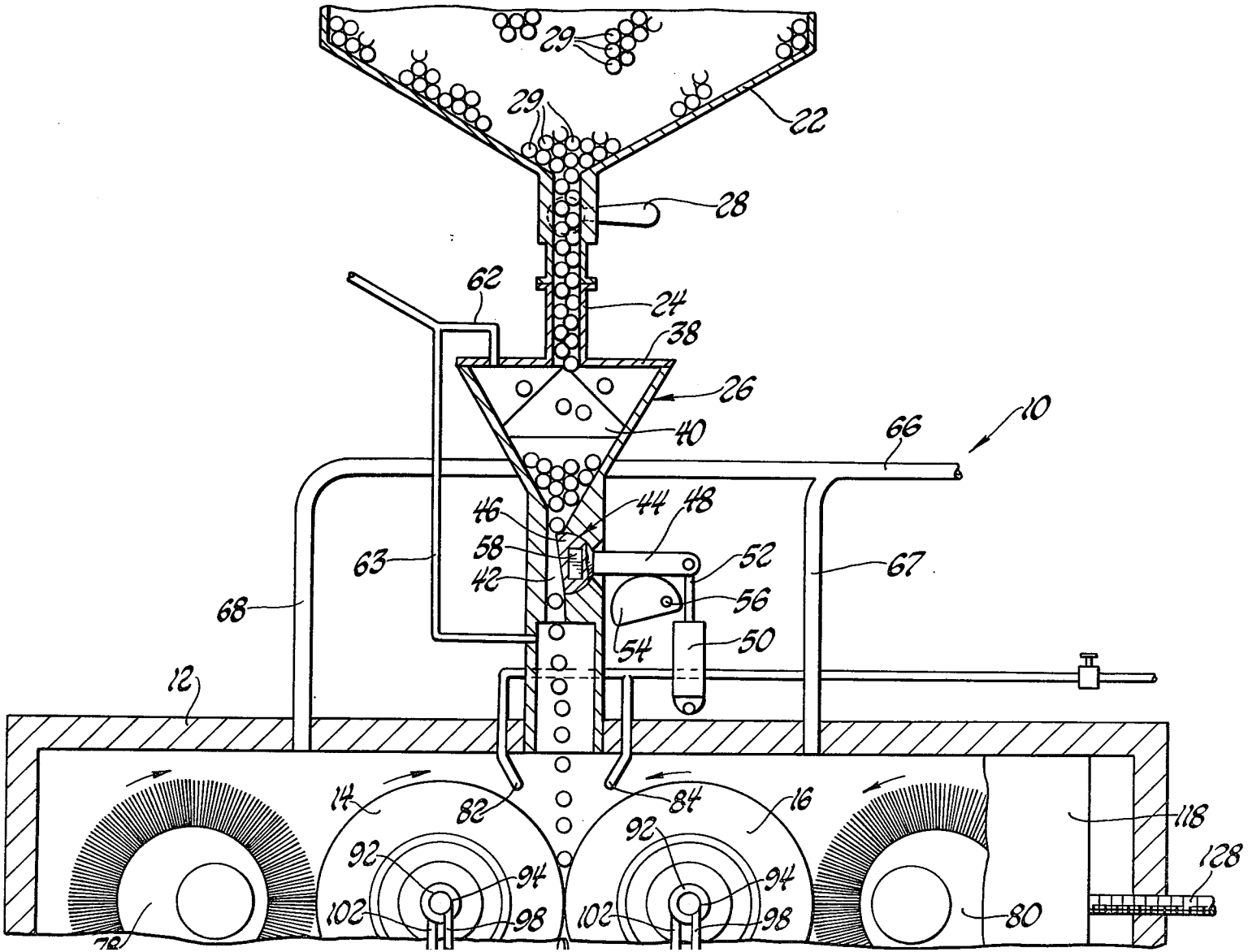
Figure 2:
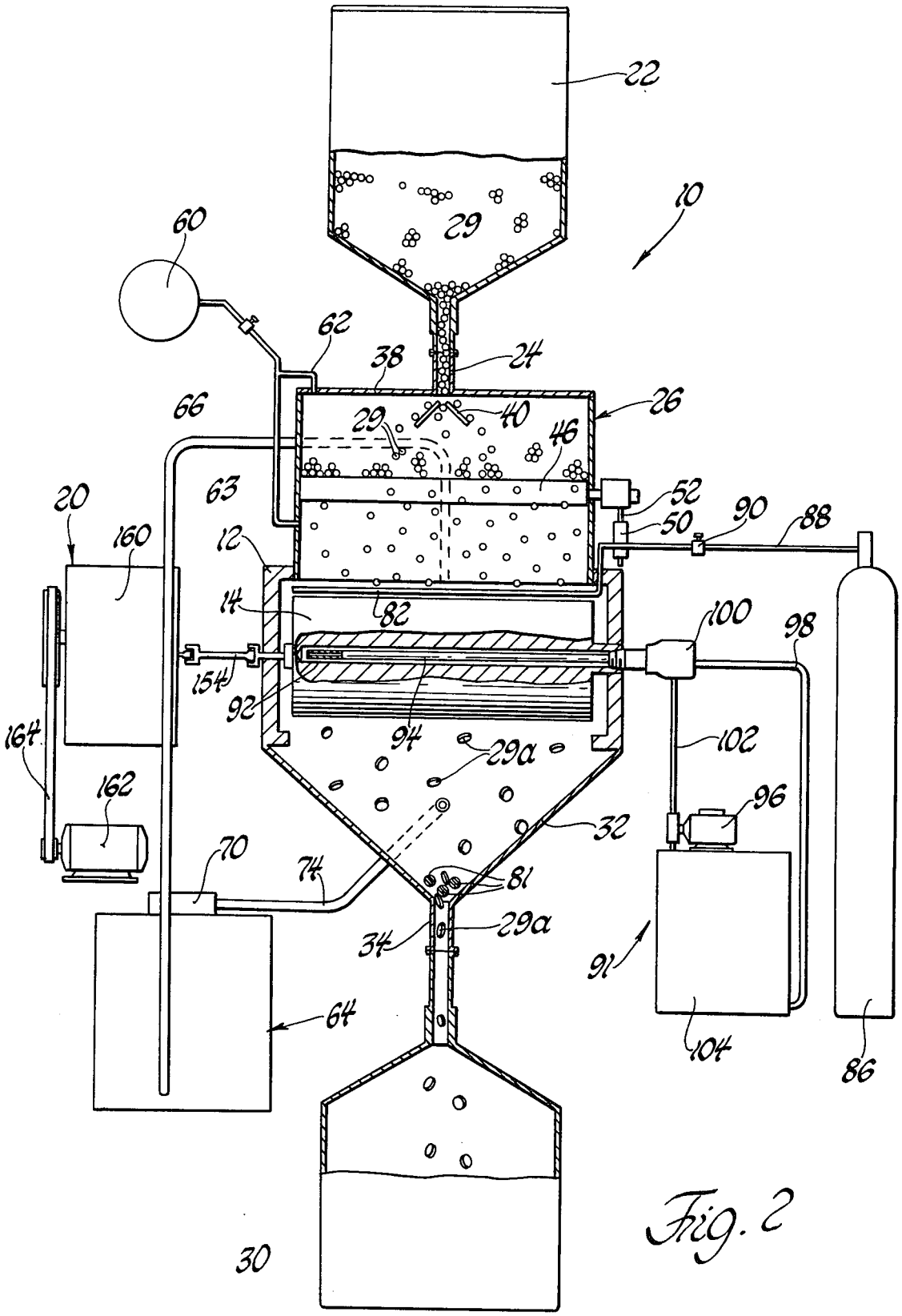
FIG. 2 is a side-elevational view of the apparatus shown in FIG. 1.

Referring more particularly to the drawings, FIGS. 1, 1*a*, and 2 are schematic drawings which show the basic components of the cold rolling apparatus. More specifically, the cold rolling apparatus generally shown at 10, includes an enclosed work chamber 12. The work chamber 12 houses and supports a pair of rolls 14 and 16 which are rotatably driven by drive means, generally indicated at 20, which will be described in greater detail herein. The material for the rolls is selected depending on the type of powder being rolled. In the case of superalloy powder carbide rolls are used. As-atomized powder is transported from the atomization equipment in a container 22 which is suitably supported by framework (not shown) above the cold rolling apparatus. The as-atomized powder is conducted into the enclosed work chamber 12 through a conduit 24 and metering means, generally indicated at 26. The container 22 is preferably provided with a valve operated by a handle 28 for opening and closing the container 22 when desired.

As indicated in FIGS. 1*a* and 2, as-atomized powder particles pass from the container 22 through the metering means 26 and into the enclosed work chamber 12 whereupon it passes between the rolls 14 and 16. The spherical powder particles 29 are pressed between the rolls 14 and 16 and deformed into coin, or ellipsoid-like, shapes 29*a*. It is here noted that the particles 29 and 29*a* shown in the drawings are merely representative and are shown for purposes of illustration only. That is, they are not intended to indicate the size of the particles involved. In fact, the as-atomized powder particles have a size range in the neighborhood of −40 to +60 mesh. Subsequent to cold rolling the coined, or flattened, powder particles 29*a* fall by gravity through a funnel-shaped collecting portion 32 of the enclosed work chamber 12, through a conduit 34 and then into a receiving can 30. The receiving can 30 is preferably provided with a valve operated by a lever 36 for closing the receiving can 30 once it has been filled. The cold worked powder can then be transported to other processing stations.

Due to the small size of the particles being rolled, the two rolls 14 and 16 are actually continuously in contact. As will be described herein, adjustment means is provided for adjusting the contact pressure between the rolls. As a powder particle passes between the rolls 14 and 16, the rolls are deflected to permit the particles to pass through; however, the pressure exerted on the particle deforms it into the coin shape. It is important to strictly control the amount of powder passing between the rolls since an excess amount of powder will deflect the rolls too much so that some of the particles will either not be cold worked or will not be sufficiently cold worked. It is also important to keep the individual powder particles sufficiently separated from other particles to prevent excessive interparticle mechanical bonding. It is essential, therefore, to provide metering means to accurately control the rate of flow of the metal powder to the rolls.

As shown in FIG. 1, the metering means 26 includes an upper funnel-like portion 38 which receives powder in bulk from the container 22. A spreader device 40 is disposed within the funnel portion 38 immediately below the conduit 24 to spread the metal powder along the length of the funnel portion 38 as shown in FIG. 2.

The funnel portion 38 tapers into a narrow passage 42. The passage 42 includes an elongated adjustable valve, generally indicated at 44, for opening and closing the passage 42. The valve 44 includes an elongated valve body 46 which is seated in a valve seat disposed in the wall of the passage 42. A lever 48 is connected to the valve body 46 to rotate the same between the closed and a range of open positions. A fluid operated cylinder 50, such as, an air cylinder, is connected to the lever 48 by means of a piston rod 52. The air cylinder 50 normally biases the lever 48 against a rotatable cam 54 which is rotatable about a pivot pin 56. The position of the cam 54 determines the position of the valve body 46 and, consequently, the size of the opening in the passageway 42. Means, such as a handle (not shown), is provided for adjusting the position of the cam 54 to control the amount of powder passing through the passage 42.

Generally, the gap, or opening, in the passage 42 determined by the valve body 46 is set at about three times the average diameter of the powder particles passing through the passageway 42. It is noted at this point, that prior to cold rolling, it is necessary to classify the as-atomized powder by size to prevent extreme variations in the size of the powder particles passing through the rolls. As can be appreciated, a large particle would deflect the rolls 14 and 16 to such an extent that a number of small particles could pass between the rolls without being cold worked. It is necessary, therefore, to limit the size range of the powder in each batch being cold rolled.

To further facilitate even, steady flow of the powder through the metering means 26, the valve body includes an electronic vibratory device 58 to keep the powder from becoming clogged in the passageway above the valve body 46. The vibratory device may be of any convenient design, such as, an electromagnetic vibrator.

In the event of a power failure which would cause the rolls 14 and 16 to cease rotating, safety shut-off means is provided for curtailing the flow of metal powder into the chamber 12. The safety shut-off prevents a build-up of powder between the rolls. Any build-up of powder would require removal before starting the rolling apparatus again. If the powder is left between the rolls, excessive deflection of the rolls may occur which could cause fracture of the rolls. In any event, if to much powder passes through the rolls much of the powder would not be sufficiently cold worked. The safety shut-off means employs the air cylinder 50. Normally, the air cylinder 50 holds the lever 48 against the cam 54. In the event of a power failure, the direction of force of the air cylinder 50 is reversed and the lever 48 is moved away from the cam 54 to close the valve 46. A number of suitable systems for accomplishing this result will immediately be apparent to one skilled in the art, therefore, the specifics of the system are not shown. For example, a pressure accumulator can be incorporated with the air system which operates the air cylinder. When a power failure occurs causing a drop in the normal air pressure, the air pressure, in the accumulator closes the valve. Suffice it to say, however, that safety shut-off means is provided which is responsive to a failure of the drive means to move the valve 46 to a closed position.

In summary, the metering means 26 produces a substantially uniform, thin curtain of powder particles which falls between the rolls 14 and 16 and is adapted to shut off the flow of powder in the event of a power failure.

Since the metal powder being processed can be highly reactive, particularly the superalloys, it is necessary to protect the powder from gaseous atmospheric contaminants, such as, oxygen and nitrogen which tend to form oxides and nitrides in the powder. This problem is particularly acute since the cold rolling process develops heat which makes the powder particularly susceptible to the absorption of such contaminants. Since it is difficult to evacuate large chambers, particularly when mechanical operations are being carried out within the chamber, it is much more practical to introduce an inert atmosphere into the chamber and, thus, protect the powder than to carry out the process under a vacuum. Accordingly, means is provided for introducing a suitable inert gas into the chamber 12 to produce an inert atmosphere. More specifically, argon gas is conducted from a tank 60 through pipes 61, 62 and 63 into the metering means 26 from which it flows into the chamber 12. As shown, the main supply pipe 61 is provided with a shut-off valve 64. The argon gas is supplied under pressure so that a positive pressure is built up in the chamber 12. It is not necessary to perfectly seal the chamber 12 since the argon gas is introduced at a positive pressure. Therefore, the inert gas flows from within the chamber through any small openings or breaks in the seals. This continuous outward flow of inert gas results in a continuous purge which prevents contaminating gas from entering the chamber 12 through any of the openings and carries away any contaminating gases which may have entered the chamber.

As suggested above, it is possible for pieces of refractory material to find their way into the powder metal during the atomization process. Since it is undesirable for material of this nature to be in the consolidated article because they are potential sources of crack initiation, it is necessary to take steps to remove such foreign materials. To accomplish this the cold rolling apparatus 10 includes circulating and filter means generally indicated at 65. It has been found that the pieces of refractory material, after being crushed between the rolls 14 and 16, are small enough and light enough to be separated from the metal powder and carried away by a current of inert gas. Accordingly, means, comprising an exhaust duct 66 and branch ducts 67 and 68, is provided for drawing inert gas from the chamber 12. The inert gas is drawn from the chamber 12 through the exhaust duct 66 by means of a recirculating pump 70 which, in turn, conducts the inert gas, laden with very minute pieces of solid contaminants, through a filter device 72. The filter device 72 may be provided with electrostatic filters or a suitable filter media to remove the solid contaminants from the inert gas. The inert gas is then returned to the chamber 12 through a return duct 74 and branch ducts 75 and 76. As shown in FIG. 1 the exhaust duct 66 and the return duct 74 are arranged with respect to the chamber 12 to produce a continuous flow of inert gas through the chamber 12 in a direction opposite to that of the falling metal powder. This cross flow, as indicated by arrows in FIG. 2, separates the minute solid contaminants from the falling powder and carries them upwardly where they are drawn off through the exhaust duct 66 and removed by the filter device 72.

Without taking appropriate steps during cold rolling, it is possible for the powder to adhere to the rolls 14 and 16. If this continues, the rolls will acquire a layer of powder metal of steadily increasing thickness. This, of course, is highly undesirable. To avoid this, metal-bristled cylindrical brushes 78 and 80 are located adjacent the rolls 14 and 16 to remove any powder particles which may adhere to the surface of the rolls. As shown in FIG. 1*a,* the brushes 78 and 80 are rotated in the same direction as the roll with which it is associated. However, the brushes are rotated at a speed exceeding that of the rolls. It has been found that a speed approximately four times greater than that of the rolls is effective. This insures efficient cleaning of the surface of the rolls. As will be described in greater detail herein, the shafts which support the rolls 78 and 80 are mounted eccentrically with respect to rotatable journal boxes to permit adjustment of the brushes 78 and 80 with respect to the rolls. In other words, provision is made for moving the brushes toward and away from the rolls as desired.

It has been noted that the steel brushes 78 and 80 can also be a source of contaminants in that small pieces of the metal bristles may break off. Since these broken bristles are usually too heavy to be carried off and removed by the circulating and filter means 65, they tend to fall with the cold worked powder into the receiving can 30. Since the metal brushes are preferably made of carbon steel, the bristles are magnetic while the powder is not. In order to separate the broken bristles from the powder, one or more permanent magnet bars 81 are supported in the chamber 12 near the entrance to the conduit 34. The broken pieces of the brushes are attracted to and are collected by the magnets 81. Periodically, the magnets 81 are removed from the chamber 12 and cleaned.

To further prevent powder from adhering to the rolls during cold rolling, lubricating means is provided for applying a lubricant to the metal powder prior to its passage through the rolls 14 and 16. For this purpose a gaseous lubricant is employed, a stream of which is directed toward the curtain of metal powder through a pair of elongated manifolds 82 and 84. The lubricant is supplied under pressure from a tank 86 and is conducted to the manifolds 82 and 84 through a conduit 88. The conduit 88 includes a shut-off valve 90 for controlling the flow of lubricant. The lubricant must be noncontaminating with respect to the metal powder and must be easily removable in a subsequent degassing, or scrubbing, operation. It has been found that inert, nonflammable derivatives of methane or ethane are highly suited for this purpose. FREON has proven to be very satisfactory since it does not contaminate the powder and can be easily identified and removed in subsequent operations. The FREON effectively coats the surface of the powder particles and also the surface of the rolls to prevent metal-to-metal contact and, thus, keeps the powder from adhering to surface of the rolls.

Since deformation of the metal powder particles generates large quantities of heat, it is necessary to provide means for cooling the rolls 14 and 16. Accordingly, a cooling system, generally shown at 91, is provided. Each of the rolls includes a blind bore 92 located along its central axis for receiving a pipe 94. The pipe 94 conducts a coolant, such as, water, through the roll. A pump 96 is employed for pumping the coolant through a tube 98 into a fitting 100 and then through the pipe 94. The coolant exits the end of the pipe 94 and flows back toward the fitting 100 through the bore 92 and thence through a return pipe 102 into a heat exchanger 104.

Reference is now made to FIG. 3 which shows a cross-sectional view of a cold rolling apparatus constructed in accordance with the instant invention more in the nature of a machine drawing than the schematics of FIGS. 1, 1*a,* and 2. As indicated above, FIG. 3 is a view taken generally along line 3—3 of FIG. 1; however, it is not an acurate cross section in that FIG. 3 shows substantially more detail than is shown in FIG. 1.

As shown in FIGS. 3 and 3*a*, the construction of the chamber 12 includes a pair of end plates 106 and 108. These end plates are held together by four tie bars, such as, the tie bar 110, which are located at the four corners of the end plates 106 and 108 and extend therebetween. Each of the tie bars is rectangular in cross section and has at each end a threaded stud 112 which extends through a hole in the end plate for receiving nuts 114.

Located between the end plates 106 and 108 and supported between the tie bars 110 are two pairs of pillow blocks. A first pair of pillow blocks 116 and 118 are adapted to support one roll 16 and one brush 80 while the second pair of pillow blocks 120 and 122 are adapted to support the other roll 14 and brush 78. A compressible resilient seal 124 is disposed between adjacent counterparts of the pairs, that is, between the pillow blocks 116 and 120 and between the pillow blocks 118 and 122. The resilient seals 124 permit relative movement between the pairs of pillow blocks while maintaining a sealed condition in the chamber. The pairs of pillow blocks are movable longitudinally with respect to the tie bars in order to adjust the contact pressure between the rolls 14 and 16. As the pillow blocks are moved toward and away from one another the seals 124 resiliently collapse or expand as necessary.

In order to adjust the contact pressure between the rolls 14 and 16 jackscrew means, generally shown at 126, is provided for moving one pair of pillow blocks 116 and 118 toward the other pair of pillow blocks 120 and 122. The jackscrew means 126 consists of a pair of threaded shafts 128 and 130 which extend through threaded bores 131 in the end plate 106. The ends of each of the threaded shafts 128 and 130 abut one of the pillow blocks in the pair of pillow blocks 118 and 116 adjacent the end plate 106. The threaded shafts 128 and 130 include extensions 132 and 134 each of which extends into a transmission housing 136 and 138. Each of the extensions 132 and 134 carries a worm gear (not shown) which is engaged by a worm shaft 140. The worm shaft is rotated by a hand wheel 142. As should be apparent, rotation of the hand wheel 142 rotates the worm shaft 140 which in turn rotates the threaded shafts 128 and 130. Threaded movement of the threaded shafts 128 and 130 in the end plate 106 toward and away from the pillow blocks 118 and 116 moves the pillow blocks and, consequently, varies the contact pressure between the rolls. Threaded movement of the shafts 128 and 130 toward the left, as viewed in FIG. 3, moves the right pair of pillow blocks 116 and 118 toward the left pair of pillow blocks 120 and 122. Since the rolls 14 and 16 are carried by the pillow blocks, this movement increases the contact pressure between the rolls.

It is noted that the entire adjusting arrangement is carried by the end plate 106 through the threaded shafts 128 and 130 so that the jackscrew means 126 moves in and out with the threaded shafts 128 and 130. It is not necessary, therefore, to independently support the jackscrew means 126. To help seal the chamber 12, slide seals 144 are disposed in notches in the end plates at each corner and overlap the adjacent pillow block. The slide seals 144 compensate for movement of the pillow blocks with respect to the end plates, particularly end plate 106. Slide seals 145 are also employed between the pairs of pillow blocks to permit movement while maintaining a seal therebetween.

Each pair of pillow blocks includes aligned bores 141 for receiving the journaled ends 143 of the rolls 14 and 16. Suitable bearings and seals are located in the bores 141 of the pillow blocks. Retainer plates 146 are bolted to the pillow blocks 116, 118, 120 and 122 to hold the rolls 14 and 16 in place. As shown, the front end of each of the rolls extends through its retainer plate 146 and presents the open end of the bore 92 for connection to the fitting 100. A rotatable connection is established between the fitting 100 and a threaded nipple 148 to permit rotation of the rolls 14 and 16 with respect to the fitting 100. The rear end of each of the rolls 14 and 16 extends through its retainer plates 146 and is connected to a stub shaft 150. The two stub shafts 150 for the rolls 14 and 16 are connected through universal joints 152 to drive shafts 154. The drive shafts 154 are in turn connected through universal joints 156 to output shafts 158 from a transmission 160. The output shafts 158 are driven by the transmission 160, shown in FIG. 2, which, in turn, is powered by an electric motor 162, or other power source, and a belt drive 164. The universal connections between the transmission 160, drive shafts 154 and the stub shafts 150 are necessary to permit lateral movement of the rolls 14 and 16.

The brushes 78 and 80 are rotatably mounted on shafts 166 and 168. The ends of shaft 166 are journaled in journal boxes 170, 172, 174 and 176. The journal boxes 170, 172, 174, and 176 are rotatably mounted in bores 179 in the pillow blocks. FIGS. 4 and 5 show a typical pair of rotatable journal boxes employed in the apparatus. The stepped bores 188 and 190 in each of the journal boxes 170 and 172 which receive the ends of the shafts are located eccentrically with respect to the axis of rotation of the journal boxes. Therefore, rotation of the journal boxes changes the position of the shaft with respect to the pillow blocks and, consequently, the adjacent roll. In other words, eccentrically mounting the brush-carrying shaft in rotatable journal boxes allows the brush to be moved toward and away from the adjacent roll to adjust the contact pressure therebetween.

The forward journal box 170 terminates in a shaft 192 to which a handle 194 is attached for rotating the journal box 170. The rear journal box includes a bore 194 which extends entirely through the journal box 172 and terminates in a stub shaft 196 for rotating the brush-carrying shaft. An extension 197 is provided on each of the journal boxes and a bar 198 is connected between the extensions 197 so that the two journal boxes are rigidly connected together. For this purpose, screws 200 and pins 202 may be employed. By reason of the bar 198, rotation of the journal box 170 by means of the handle 195 causes the other journal box 172 to rotate simultaneously and in unison. Since the brush-supporting shafts 166 and 168 are laterally movable, universal connections 204 and 206 are provided for connecting the stub shafts 196 to drive shafts 208, and the drive shafts 208 to output shafts 210 from the transmission 160.

In order to insure that the contact pressure of the rolls is properly set and that properly cold worked powder is being produced, means is provided for taking a sample of the cold rolled powder. Such means consists of a spigot 212 having one end extending into the conduit 34 which communicates with the receiving can 30. Opening the valve 214 causes a sample of the cold rolled powder to escape from the conduit 34 where it is recovered in a suitable container 216 for inspection.

By employing the foregoing apparatus, spherical powder metal particles are deformed to a shape similar to that shown in FIG. 6. Basically, the spherical particles are subjected to at least a 40% reduction in a dimension of the particle along a major axis. As used herein a "major axis" is any diameter of the generally spherical powder particles. In other words, a diameter of the spherical particle undergoes a 40% reduction in its length. Powder particles deformed in this manner result in coin-shaped particles, or more precisely, ellipsoid-shaped particles having a diameter which exceeds their thickness. By visual inspection and physical measurement it appears that the diameter of most of the particles exceeds their thickness by a factor of at least two. As suggested above, a significant advantage of coin, or ellipsoid-like, shaped powder is its increased tap density over spherical powder. By way of explanation, hot isostatic pressing involves sintering of the metal particles under heat and pressure. All mechanisms of sintering powdered particles require some form of material transport to obtain intergranular bonding and consolidation of the particles to a low porosity solid. To minimize both the amount of material transported and the distance that the material must move, it is desired to have the powder particles arranged so as to have the highest mass/volume ratio possible prior to sintering. Additionally, a high mass/volume ratio indicates extensive interparticle surface contact which promotes interparticle bonding and subsequent growth of the bonds. It has been found that the tap density of cold rolled powder is significantly higher than the tap density of spherical powder. Thus, the unique shape of the cold rolled powder facilitates sintering.

The powder particle shown in FIG. 6 is not meant to suggest that all the powder particles are identical. The shapes are not all perfectly symmetrical since the original powder particles are not perfect spheres. The shape shown, however, illustrates that the thickness of the cold rolled particle is somewhat less than its diameter. This shape facilitates closer packing of the powder particles than a spherical shape and, thus, increases tap density.

The complete operation of the apparatus should be apparent from the foregoing disclosure. In summary, however, powder metal is conducted from a transport container 22, or other source, into a substantially sealed chamber 12 through metering means 26. The metering means 26 regulates the amount of powder passing into the chamber 12. Upon entering the chamber 12, the powder passes between a pair of rolls 14 and 16 which deform the powder from its generally spherical shape to a coin, or plate-like, shape. In order to prevent powder from adhering to the surface of the rolls 14 and 16, brushes 78 and 80 are provided. Additionally, a lubricant, such as FREON, is applied to the powder prior to cold rolling. To avoid contamination of the powder, an inert gas, such as, argon, is fed into the chamber 12. The pressure of the argon gas within the chamber 12 is such that a continuous outflow or purge is established which prevents atmospheric gases from entering. Minute particles of refractory material are removed by the circulating and filter means 65 which produces a flow of argon gas through the chamber 12 to pick up such particles for removal by the filter 72. Permanent magnets 81 are also provided for collecting any magnetic particles, such as, broken-off pieces of the brush bristles. In order to accommodate different batches of powder wherein one batch has a size range differing from that of another batch, the rolls 14 and 16 are mounted so that the contact pressure between them can be adjusted. In order to insure proper cleaning of the rolls 14 and 16, the brushes 78 and 80 are mounted for movement toward and away from the rolls 14 and 16. Adjusting the position of the brushes is accomplished by mounting their support shafts eccentrically in rotatable journal boxes. In order to eliminate the heat generated by the cold rolling process, a cooling system 91 is provided for cooling the rolls during cold rolling.

The powder metal produced in the foregoing manner is in a highly cold worked state and is well suited for subsequent hot isostatic pressing and the forming of compacts having the characteristics of superplasticity. Additionally, the powder metal is substantially free of hollow particles and nonmetallic inclusions. Moreover, cold rolling procedures a powder having a higher tap density than the original as-atomized powder.

This invention has been described in an illustrative manner, and it is to be understood that the terminology which has been used intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. Cold rolling apparatus for powder metal comprising: an enclosed work chamber, a pair of rolls mounted for rotation within said chamber, drive means for rotatably driving said rolls, metering means for permitting the passage of metal powder between said rolls at a predetermined rate, supply means for supplying metal powder in bulk to said metering means, means for introducing an inert gas into said chamber, circulating and filter means for drawing said inert gas from said chamber, filtering said inert gas to remove solid contaminants, and returning filtered inert gas to said chamber, lubricating means for applying a lubricant to said metal powder prior to its passage through said rolls to reduce bonding of the powder particles to the rolls and to each other, and receiving means for receiving said metal powder subsequent to its passage through said rolls.

2. An apparatus as set forth in claim 1 wherein said metering means includes a passage, an adjustable valve associated with said passage for opening and closing the same, and adjustment means for adjusting the position of said valve to control the amount of metal powder passing through said passage.

3. An apparatus as set forth in claim 2 wherein said valve includes safety shutoff means responsive to a failure of said drive means to move said valve to close said passage.

4. An apparatus as set forth in claim 3 wherein said safety shut-off means includes a fluid-operated cylinder connected to said valve for moving said valve between open and closed positions.

5. An apparatus as set forth in claim 3 wherein said metering means includes vibratory means for vibrating said valve to facilitate the flow of metal powder past said valve.

6. An apparatus as set forth in claim 1 including cleaning means for cleaning said rolls.

7. An apparatus as set forth in claim 6 wherein said cleaning means includes a pair of brushes, one brush being mounted adjacent each of said rolls.

8. An apparatus as set forth in claim 7 including a pair of shafts for supporting said brushes, a pair of rotatable journal boxes supporting the ends of each of said shafts, said shafts being eccentrically mounted with respect to the axis of rotation of said journal boxes and means for simultaneously rotating each pair of said journal boxes to adjust the distance between said brush-supporting shaft and said adjacent roll.

9. An apparatus as set forth in claim 8 wherein said means for simultaneously rotating each pair of said journal boxes includes a bar rigidly joining said journal boxes together and means for rotating one of the journal boxes of each pair.

10. An apparatus as set forth in claim 9 including pairs of pillow blocks for rotatably supporting the ends of each of said rolls and for supporting said journal boxes whereby each pair of pillow blocks ultimately supports a set of one of said rolls and one of said brushes and means supporting said pairs of pillow blocks for movement toward and away from one another to adjust the position of said rolls.

11. An apparatus as set forth in claim 10 including means for moving said pairs of pillow blocks toward and away from one another.

12. An apparatus as set forth in claim 11 wherein said drive means includes drive shafts connected to said brushsupporting shafts and said rolls, said drive shafts including universal joints to permit movement of said rolls and brushes.

13. An apparatus as set forth in claim 3 including cooling means for circulating a coolant through said rolls.

14. An apparatus as set forth in claim 13 including magnetic trap means for removing pieces of magnetic materials from the metal powder.

15. An apparatus as set forth in claim 14 wherein said magnetic trap means includes a plurality of permanent magnets supported in said chamber below said rolls.

16. Cold rolling apparatus for powder metal comprising: a substantially sealed, enclosed work chamber, said work chamber including two pairs of opposing pillow blocks; a roll and a brush supported by each of said pairs of pillow blocks, said rolls being adjacent one another; drive means for rotating said rolls and brushes; metering means for feeding a controlled amount of powder to said rolls; means for maintaining an inert atmosphere within said chamber, said means including circulating and filter means for circulating said inert atmosphere through said chamber and removing solid contaminants therefrom; and adjustment means for adjusting the position of said rolls relative to one another.

17. An apparatus as set forth in claim 16 including means for slidably supporting said pairs of pillow blocks, said adjustment means including means for moving said pairs of pillow blocks toward and away from one another.

18. An apparatus as set forth in claim 17 wherein said means for moving said pairs of pillow blocks includes jackscrew means supported by said chamber.

19. An apparatus as set forth in claim 18 wherein said chamber includes a pair of opposed end plates and tie bars connecting said end plates; said jackscrew means including a pair of threaded bores extending through one of said end plates, a threaded shaft in each of said bores, said shafts being in force transmitting relationship to said pillow blocks, and means for rotating said threaded shafts to move one pair of said pillow blocks toward the other of said pairs.

20. An apparatus as set forth in claim 17 including a shaft for supporting each of said brushes, journal boxes supported by said pillow blocks, said journal boxes being rotatable with respect to said pillow blocks and including eccentrically located bores for receiving the journaled ends of said shafts whereby rotation of said journal boxes varies the position of said brush with respect to said roll.

21. An apparatus as set forth in claim 16 wherein said circulating and filter means includes exhaust duct means for drawing said inert atmosphere from said chamber, filter means for filtering said atmosphere to remove solid contaminants, and return duct means for returning said filtered atmosphere to said chamber.

22. An apparatus as set forth in claim 16 including lubricating means for applying an inert lubricant to the metal powder prior to passage through said rolls.

23. An apparatus as set forth in claim 22 including cooling means for circulating a coolant through said rolls.

24. An apparatus as set forth in claim 23 including magnetic trap means for removing pieces of magnetic material from the metal powder.

25. An apparatus as set forth in claim 24 wherein said magnetic trap means includes a plurality of permanent magnets supported in said chamber below said rolls.

26. A method for cold rolling powder metal comprising the steps of:

a. metering a controlled amount of powder metal into an enclosed work chamber,
b. lubricating the powder metal by coating the particles with an inert lubricant,
c. deforming the individual particles of powder metal between a pair of rotating rolls,
d. continuously purging the chamber with an inert gas during deforming by continuously circulating the inert gas through said chamber and removing and filtering the inert gas to remove solid contaminants and thereafter returning the filtered inert gas to said chamber.

27. The method as set forth in claim 26 including the step of cleaning the rolls of adhering metal particles by means of brushes.

28. The method as set forth in claim 27 including the step of removing pieces of magnetic materials from powder metal by means of permanent magnets.

29. The method as set forth in claim 28 including the step of cooling the rolls during deforming.

* * * * *